US007034753B1

(12) United States Patent
Elsallal et al.

(10) Patent No.: US 7,034,753 B1
(45) Date of Patent: Apr. 25, 2006

(54) MULTI-BAND WIDE-ANGLE SCAN PHASED ARRAY ANTENNA WITH NOVEL GRATING LOBE SUPPRESSION

(75) Inventors: Mohamed Wajih A. Elsallal, Amherst, MA (US); James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 20 days.

(21) Appl. No.: 10/882,977

(22) Filed: Jul. 1, 2004

(51) Int. Cl.
*H01Q 1/38* (2006.01)

(52) U.S. Cl. ..... 343/700 MS

(58) Field of Classification Search ..... 343/700 MS, 343/830, 846, 848, 853, 844, 777
See application file for complete search history.

(56) References Cited

U.S. PATENT DOCUMENTS 4,228,436 A * 10/1980 DuFort ..... 342/371
4,639,732 A * 1/1987 Acoraci et al. ..... 342/371
6,043,791 A * 3/2000 Kinsey ..... 343/853
6,118,406 A * 9/2000 Josypenko ..... 343/700 MS

OTHER PUBLICATIONS

Patent Application for "Multiband Phased Array Antenna Utilizing a Unit Cell", by James B. West et al., U.S. Appl. No. 10/141,269, May 8, 2002.

"Phased Array Antennas", R. C. Hansen, John Wiley and Sons, 1998, pp 20-23.

"Experimental Results on Multi-Beam Receiving Antenna for Satellite Broadcasting" NHK Laboratories Note No. 463, by M. Fujita et al., Apr. 2000.

"Wide-angle Scanning with Reflector Antennas: a New Design Technique", by P. L. Detweiler and K. M. Pasala, IEEE National Aerospace and Electronics Conference, 2000, pp 136-145.

"High-Band, 35 GHz Beam Forming Active Array Antenna for Future Combat Sytems Applications" by G. Lehtola et al., FCS Kickoff Meeting Presentation, US Army Contract DAAD19-01-9-0001, Feb. 20, 2001.

* cited by examiner

*Primary Examiner*—Don Wong
*Assistant Examiner*—Minh Dieu A
(74) *Attorney, Agent, or Firm*—Nathan O. Jensen; Kyle Eppele

(57) ABSTRACT

A multi-band wide-angle scan phased array antenna with novel grating lobe suppression has a first plurality of radiation elements for radiating a first frequency arranged in a rectangular configuration. A second plurality of radiation elements for radiating second frequency are arranged in a rectangular frame around the first radiation elements. A third plurality of radiation elements for radiating third frequency are arranged in a rectangular frame around the second radiation elements. The radiation elements are apertures that are λ/2 of an operating frequency in size. The radiation elements may also be arranged in square, circular, or elliptical configurations.

20 Claims, 7 Drawing Sheets

MULTI-BAND WIDE-ANGLE SCAN PHASED ARRAY ANTENNA WITH NOVEL GRATING LOBE SUPPRESSION

CROSS REFERENCE

Related U.S. patent application Ser. No. 10/141,269, "Multiband Phased Array Antenna Utilizing A Unit Cell", by James B. West and Mohamed Wajih A. Elsallal, now U.S. Pat. No. 6,650,291, is hereby incorporated by reference.

BACKGROUND OF THE INVENTION

This invention relates to antennas, phased array antennas, and specifically to a multi-band, wide-angle scan, and narrow beamwidth phased array antenna with grating lobe suppression.

Over the last four decades, much effort has been given to the development of methods to scan reflector antennas through large angles. Techniques for shaping the reflector to compensate for the distortion caused by scanning have been investigated as disclosed in "Wide-Angle Scanning with Reflector Antennas: a New Design Technique", IEEE National Aerospace and Electronics Conference, 2000, pp. 136–145. The technological challenges to cancel sidelobes and suppress clutter are known.

Previous attempts to provide antennas with multi-band wide-angle scan capabilities have included passive interlaced arrays where two antenna arrays of some type on different bands are assembled together or interlaced to reduce size. Interlaced arrays are limited in the number bands of operation where three and four band operation needed for current applications is difficult to obtain. Antennas employing reflector technology such as parabolic reflectors are difficult to implement in multiple bands. Furthermore, such antennas typically have slow mechanical beam scanning making it difficult to track a communications satellite in a rapidly maneuvering vehicle. Lens antennas are difficult to implement in multi-band designs. A three or more band configuration requires different focal points.

A phased array antenna is a beam forming antenna in which the relative phases of the respective signals feeding the antennas are varied such that the effective radiation pattern of the phased array is reinforced in a desired direction and suppressed in undesired directions. The relative amplitudes of constructive and destructive interference effects among the signals radiated by the individual antennas determine the effective radiation pattern of the phased array. A phased array may be used to rapidly electronically scan in azimuth or elevation. Previous phased arrays have been limited in bandwidth.

Ultra broadband radiating elements in conventional phased array antennas initiate grating lobes. Grating lobes are referred to as secondary maxima that appear with the main beam of the phased array antenna along the visible region. A grating lobe impacts the phased array antenna by dividing transmitted and received power into false and main beams. The grating lobe provides ambiguous directional information from that associated with the main beam.

Efficient broadband radiating elements tend to be large thereby making an entire phased array too large for many applications. Excessively large radiating element size forces a wide element-to-element spacing within a phased array that generates grating lobes at the high end of the bandwidth.

What is needed is a phased array antenna system with wide-angle scanning and simultaneous multi-beam multi-band operation without undesired grating lobes.

SUMMARY OF THE INVENTION

A multi-band wide-angle scan phased array antenna with novel grating lobe suppression is disclosed. The phased array antenna comprises a first band antenna with a first plurality of radiation elements for radiating at a first frequency. The phased array antenna further comprises a second band antenna with a second plurality of radiation elements around the first band antenna for radiating at a second frequency. The phased array antenna further comprises a third band antenna with a third plurality of radiation elements around the second band antenna for radiating at a third frequency. The first band antenna may be arranged in a square configuration with the second plurality of radiating elements of the second band antenna arranged in a square frame around the first band antenna. The third plurality of radiation elements of the third band antenna may be arranged in a square frame around the second band antenna. The first band antenna may be arranged in a rectangular configuration with the second and third band antennas arranged in rectangular frames around the first band antenna. The first band antenna may be arranged in a circular or elliptical configuration with the second and third band antennas arranged in circular or elliptic rings around the first band antenna.

The first, second, and third plurality of radiation elements comprise radiation elements of apertures that are typically $\lambda/2$ of an operating frequency in size. The first band antenna may have a side dimension equal to or less than 13.3 wavelengths at the first frequency. The second band antenna may have a side dimension equal to or greater than 30 wavelengths at the second frequency. The third band antenna may have a side dimension equal to or greater than 30 wavelengths at the third frequency.

It is an object of the present invention to provide a phased array antenna with multi-beam and multi-band operation.

It is an object of the present invention to provide a phased array antenna with wide-angle scanning without undesired grating lobes.

It is a feature of the present invention to provide a phased array antenna with very narrow beamwidth.

It is a feature of the present invention to maximize the grating lobe free scan volume for each frequency band in a multi-band phased array antenna.

It is an advantage of the present invention to minimize mechanical blockage and mutual coupling from one frequency band to another in a multi-band phased array antenna.

BRIEF DESCRIPTION OF THE DRAWINGS

The invention may be more fully understood by reading the following description of the preferred embodiments of the invention in conjunction with the appended drawings wherein.

DETAILED DESCRIPTION

The present invention is for a multi-band wide-angle scan phased array antenna architecture with a novel implementation for superimposing/suppressing grating lobes for narrow beam phased array applications such as communications, radar, and electronic surveillance systems.

It is well known within the art that the operation of a phased array is approximated to the first order as the product of the array factor and the radiation element pattern as shown in Equation 1 for a linear array. This analysis may be readily extended to a two-dimensional array as well.

$$E_A(\theta) \equiv \underbrace{E_p(\theta,\phi)}_{\text{Radiation Element Pattern}} \underbrace{\left[\frac{\exp\left(-j\frac{2\pi r_o}{\lambda}\right)}{r_o}\right]}_{\text{Isotropic Element Pattern}} \cdot \underbrace{\sum_N A_n \exp\left[-j\frac{2\pi}{\lambda} n\Delta x(\sin\theta - \sin\theta_o)\right]}_{\text{Array Factor}} \quad \text{Equation 1}$$

Standard spherical coordinates are used in Equation 1 and θ is the scan angle referenced to bore sight of the array. Introducing phase shift at all radiating elements within the array changes the argument of the array factor exponential term in Equation 1, which in turns steers the main beam from its nominal position. Phase shifters are RF devices or circuits that provide the required variation in electrical phase. Array element spacing is related to the operating wavelength and it sets the scan performance of the array. All radiating element patterns are assumed to be identical for the ideal case where mutual coupling between elements does not exist. The array factor describes the performance of an array of isotropic radiators arranged in a prescribed grid for a two-dimensional rectangular array grid.

Figure 1:
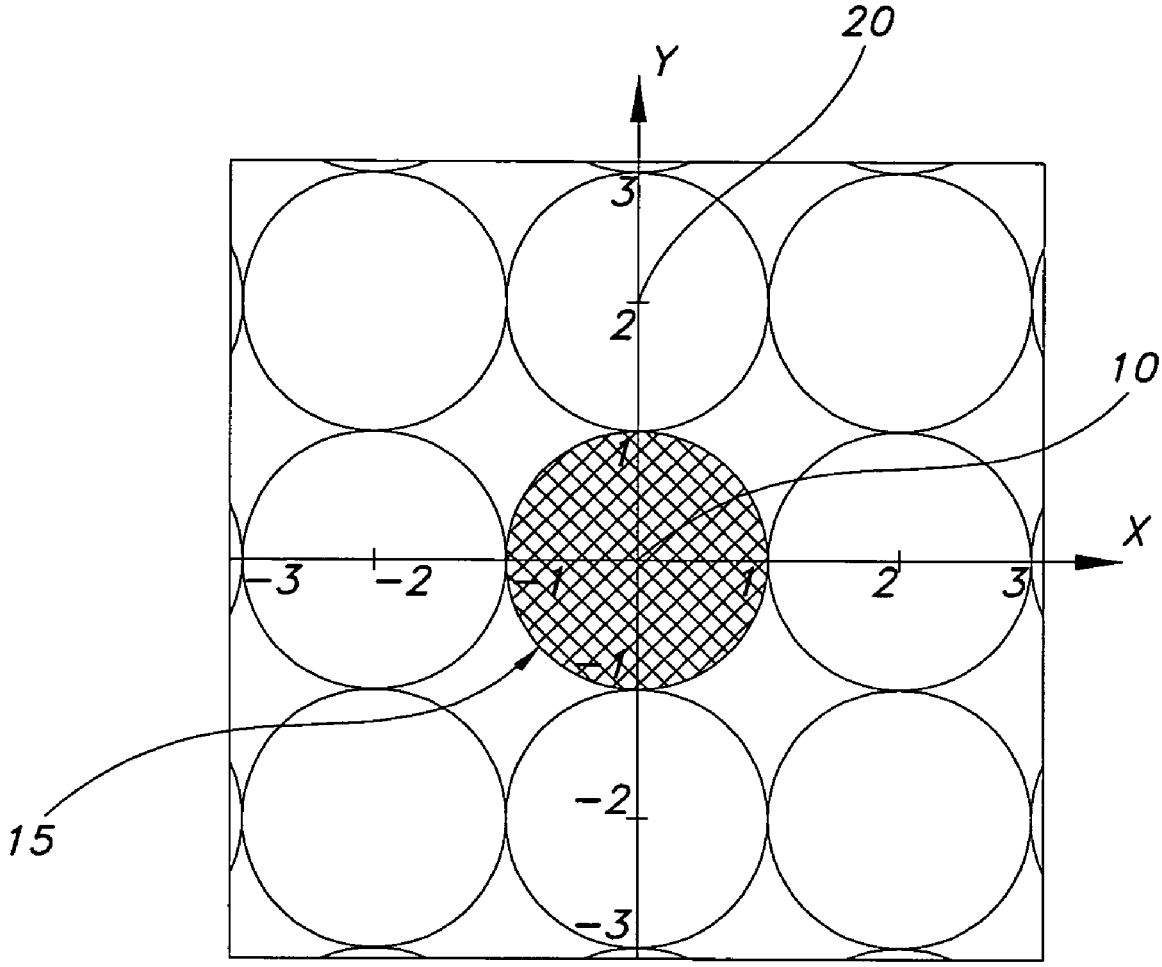
FIG. 1 is a grating lobe diagram of a phased array antenna.

The array factor of Equation 1 for a phased array located in the X, Y plane is a periodic mathematical function in k space and therefore repeats at the spacing of the array elements. FIG. 1 shows a grating lobe diagram with a main beam 10 at the origin centered in real k space within a unit circle 15 that corresponds to an elevation angle θ=π/2. The elevation angle θ=0° when the main beam 10 is broadside or coming out of the XY plane in FIG. 1. Real k space is the visible region of the phased array's radiation pattern and where power is radiated from the antenna array. Grating lobes 20 are secondary main beams and are located in imaginary or invisible k space, which is the area outside of the unit circle 15. The separation of the main lobe 10 and the grating lobes 20 is dependent on array element spacing. FIG. 1 shows the main beam 10 and the grating lobe 20 at an element spacing of a half wavelength (λ/2).

Figure 2:
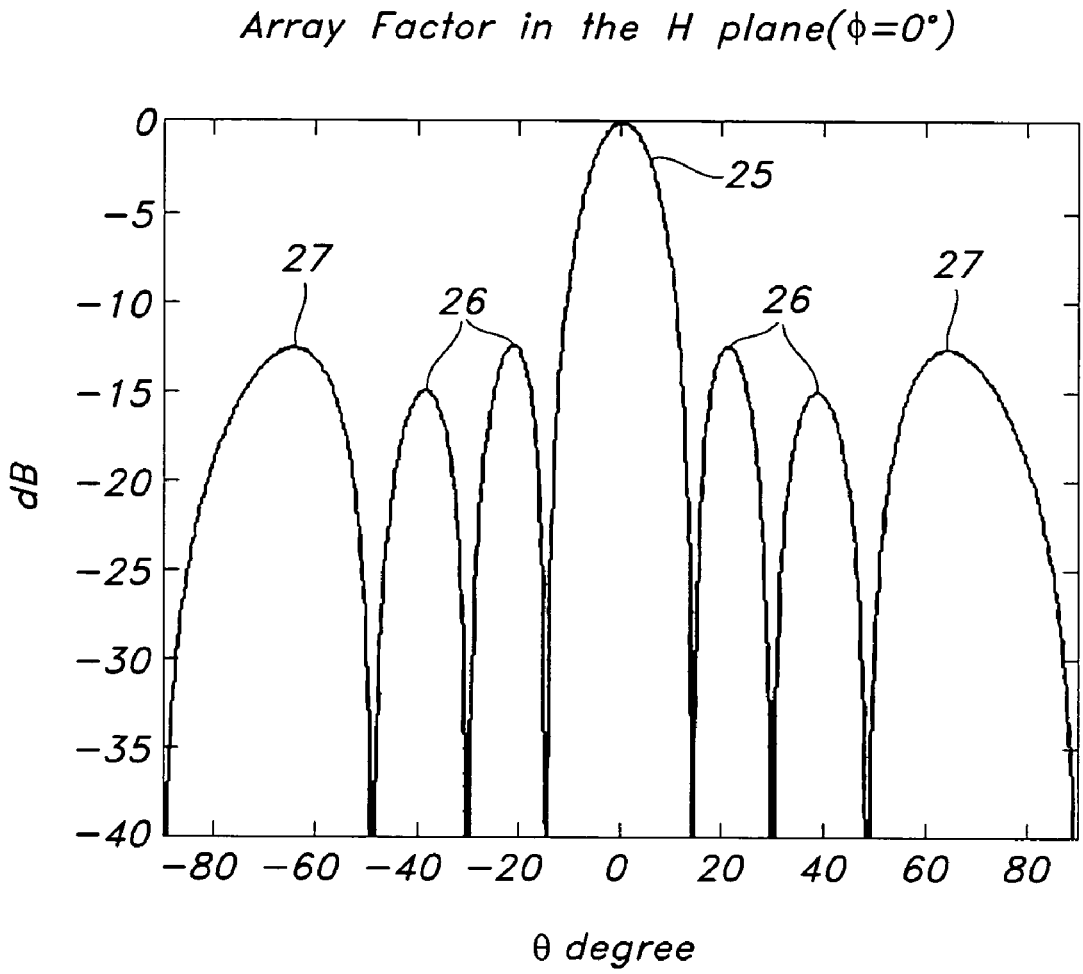
FIG. 2 shows an array factor plot in the H plane of a phased array antenna.
Figure 3:
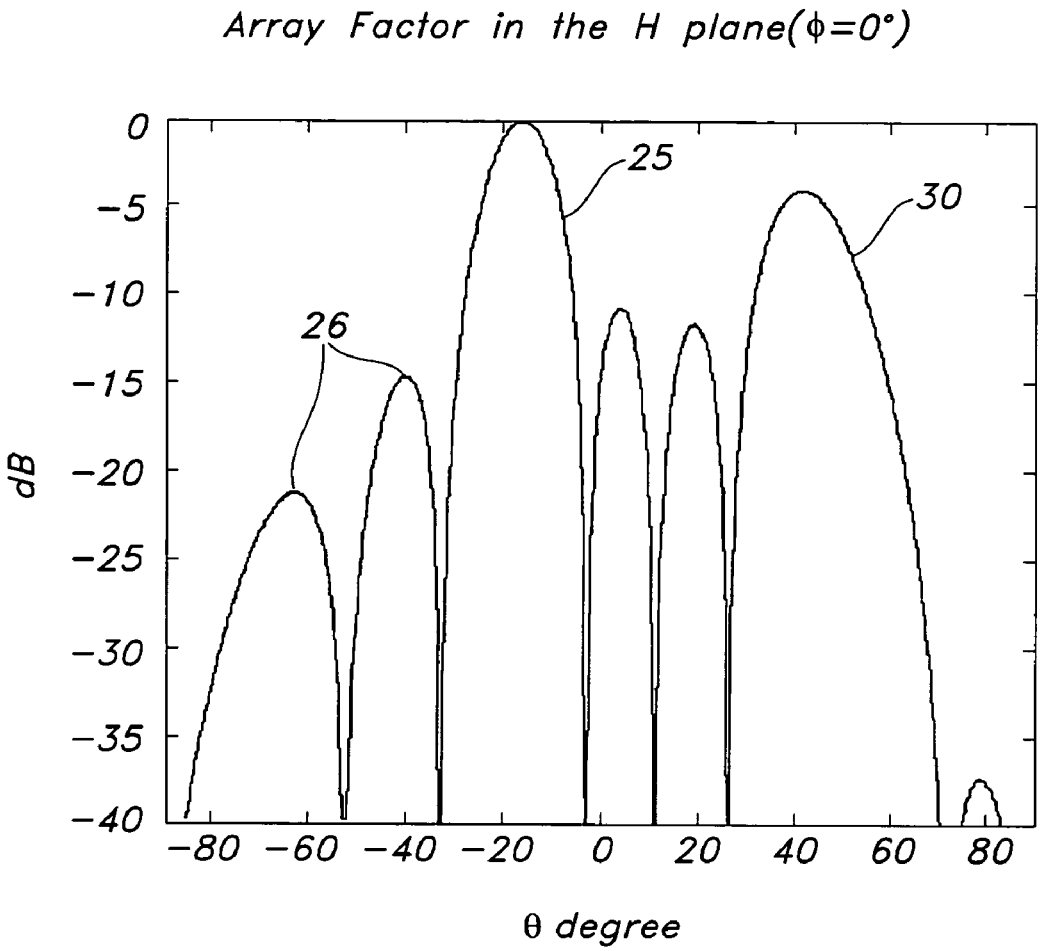
FIG. 3 shows the array factor plot of FIG. 2 with a grating lobe.

When an array is scanned by varying the elevation angle θ and/or an azimuth angle ϕ through phase scanning, the grating lobes 20 can move into real k space. FIG. 2 shows an array factor for a typical array of radiation elements spaced more than λ/2 in a phased array antenna with the main beam 10 showing a main beam response 25 at an elevation angle of θ=0° with side lobes 26 at various angles away from θ=0° with ϕ=0°. A major side lobe 27 exists because of a grating lobe entering the visible space when the radiation element spacing is more than λ/2. In FIG. 3 the main beam is moved to θ=−20° and a grating lobe 30 is shown at approximately θ=40° moving into the visible region.

A grating lobe impacts the phased array antenna by dividing transmitted and received power into false and main beams. The grating lobe provides ambiguous directional information from that associated with the main beam.

Conventional phased arrays, designed for wide angle scanning require element spacing of less than or equal to one-half free space wavelength (λ/2) to avoid the undesired formation of grating lobes within the visible space. Even for a limited scan in one place, the grating lobe restriction limits element spacing to less than one wavelength.

Figure 4:
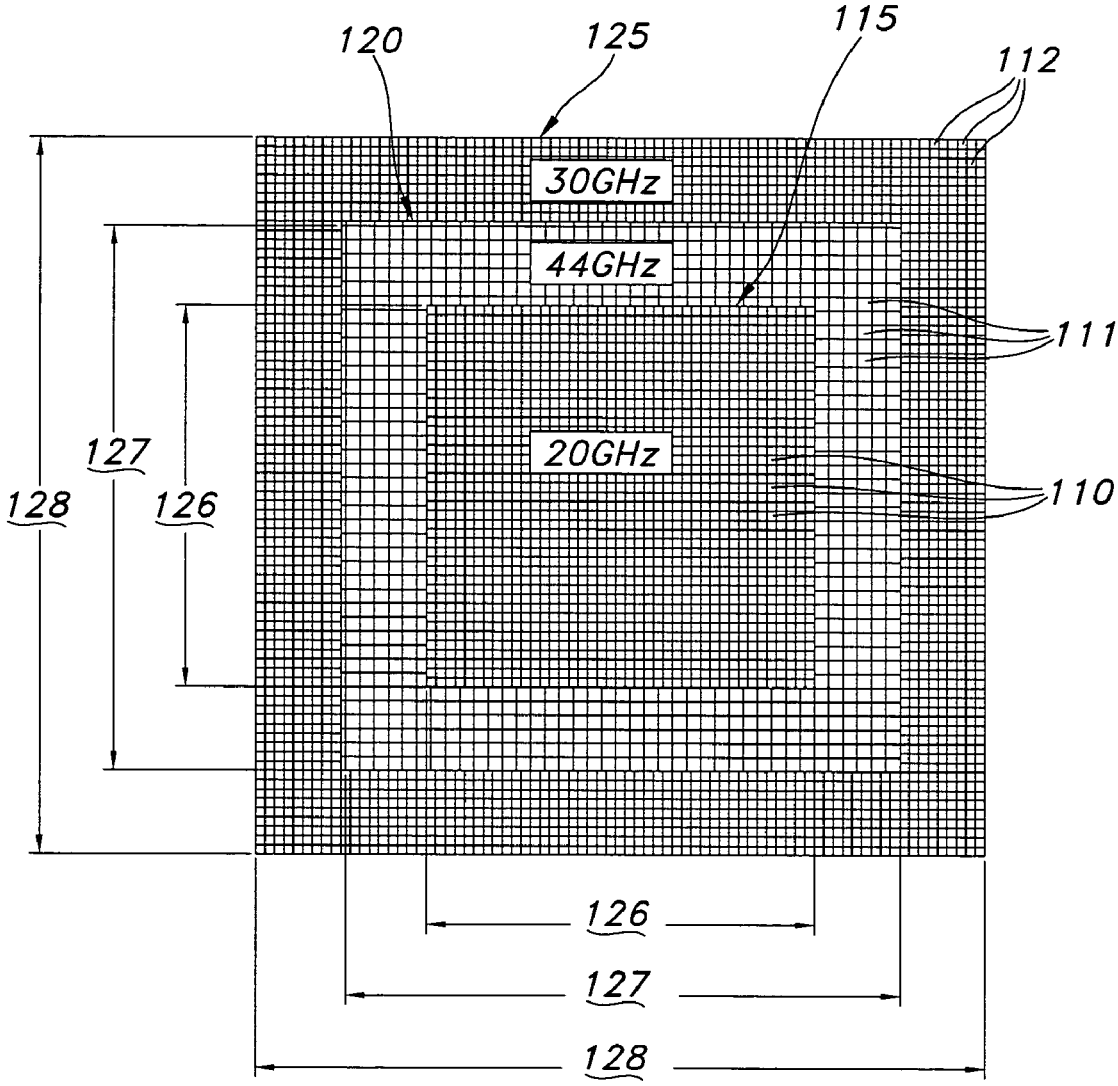
FIG. 4 shows a multi-band wide-angle scan phased array antenna with novel grating lobe suppression of the present invention in a square configuration.
Figure 5:
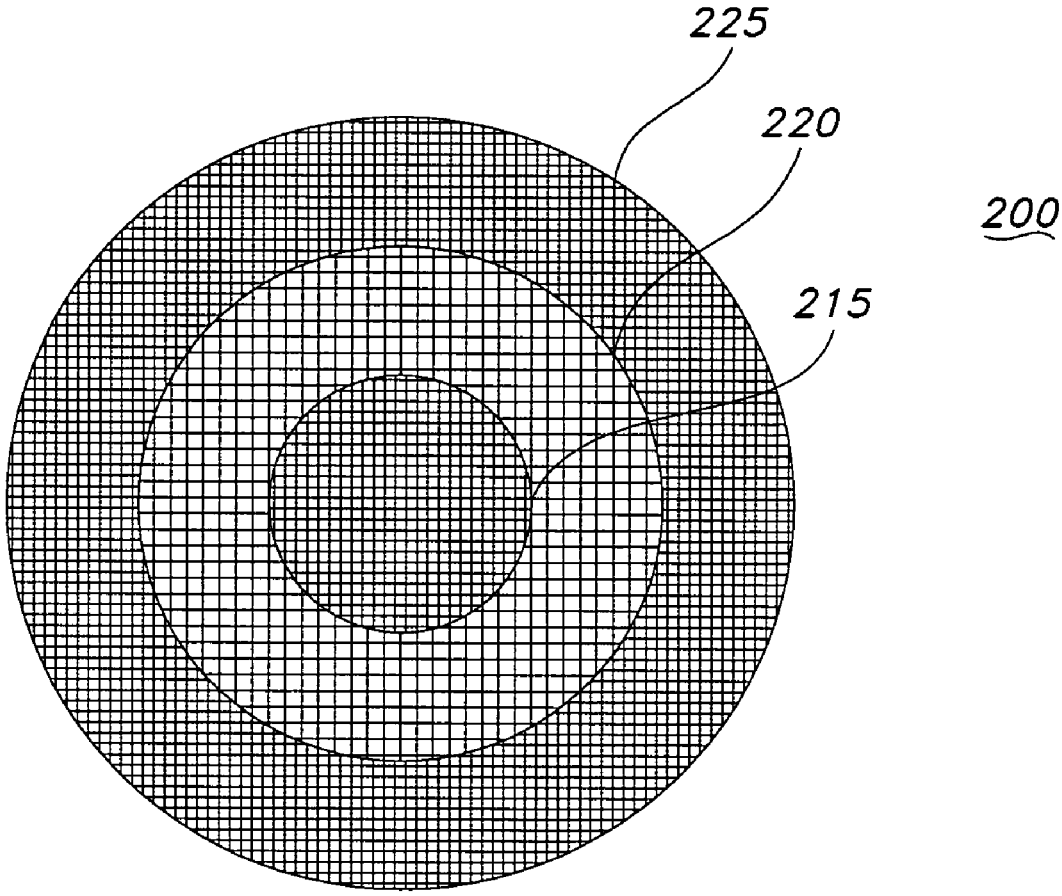
FIG. 5 is a multi-band wide-angle scan phased array antenna with novel grating lobe suppression of the present invention in a circular configuration.

A multi-band wide-angle scan phased array antenna 100 with novel grating lobe suppression of the present invention is shown in FIG. 4. In FIG. 4 a three frequency band antenna is shown with a center array for one band and frames around the center array for two bands. The center array and frames may be a rectangular or square configuration of radiation elements. A multi-band wide-angle scan phased array antenna 200 of the present invention may be implemented in a concentric ring format as shown in FIG. 5 with a circular array of elements in the center for one frequency surrounded by circular rings of radiation elements for additional frequencies. The antenna 200 may also be implemented in an elliptical format (not shown) with an elliptical array of elements in the center for one frequency surrounded by elliptical rings of radiation elements for additional frequencies. More than two frames or rings may be used with one frame or ring per frequency band. In addition, the frequencies and dimensions shown in FIG. 4 are exemplary only and other frequencies and dimensions may be used and still be within the scope of the present invention.

The antennas 100 and 200 of the present invention in FIG. 4 and FIG. 5 are a phased array for narrow beam applications that maximize the grating lobe-free scanning volume at each frequency band, minimize the mechanical blockage from one band to the other, minimize mutual coupling for a given frequency band, and also minimize mutual coupling from one frequency band to the others. The antennas of the present invention are applicable to both planar and conformal systems that consist of piece-wise planar sub-panels. The antennas of the present invention have the capability for a wide-angle scan with multi-band frequency operation and a very narrow beamwidth.

The three-band antenna 100 in FIG. 4 is formed from array radiation elements 110, 111, and 112 each with an aperture size of λ/2 or less as discussed below. The three-band wide-angle scan phased array antenna 100 is shown as an M×N radiation element square configuration (M=N) with a first band antenna array 115 comprising radiation elements 110 and operating at 20 GHz in this example. The first band antenna 115 is approximately equal to or less than 13.3 wavelengths at 20 GHz (frequency 1) as shown by dimension 126 in FIG. 4. A second band antenna array 120 is formed in a W×Z radiation element square frame-like configuration (W=Z) around the first band antenna 115 and is equal to or greater than 30 wavelengths at 44 GHz (frequency 2) as show by dimension 127. The second band antenna 120 is formed from 4325 radiation elements 111 and operates at 44 GHz in this example. A gap (not shown) may be placed between the first band antenna array 115 and the second band array 120. A third band antenna 125 is formed in an X×Y radiation element square frame-like configuration (X=Y) around the second band antenna 120 and is equal to or greater than 30 wavelengths at 30 GHz (frequency 3) as shown by dimension 128. The third band antenna 125 is formed from 2800 radiation elements 112 and operates at 30 GHz in this example.

A square configuration is shown in FIG. 4 with M=N, X=Y, and W=Z. A rectangular configuration may also be used with M≠N, X≠Y, and W≠Z with the size in wavelengths being maintained for the smallest dimension.

In the three band antenna 100 in FIG. 4 all three antennas 115, 120, and 125 may operate simultaneously. However the three antennas 115, 120, and 125 need not operate simultaneously to obtain grating lobe suppression.

Shown in FIG. 5 is the antenna 200 of the present invention implemented in a circular configuration. A center circular antenna 215 operates at 20 GHz and is ≦6.65λ in radius at 20 GHz. The center antenna 215 is surrounded by a second circular antenna 220 in a ring-like configuration that operates at 44 GHz. The second circular antenna 220 is ≧15λ in radius at 44 GHz. A third circular antenna 225 surrounds the second circular antenna 220 in a ring-like configuration and operates at 30 GHz. The third circular antenna 225 is ≧15λ in radius at 30 GHz.

The dimensions for the circular antenna 200 of FIG. 5 apply to the elliptical configuration antenna. The radii disclosed for the circular antenna 200 are used for one half the elliptical antenna minor axis length. The minor axis is 2×6.65 or 13.3 wavelengths.

Figure 6A:
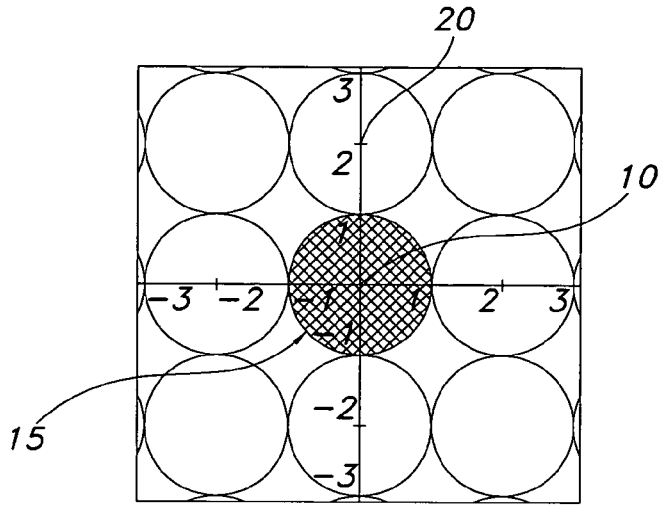
FIG. 6*a* is a grating lobe diagram of the first antenna of FIG. 4.
Figure 6B:
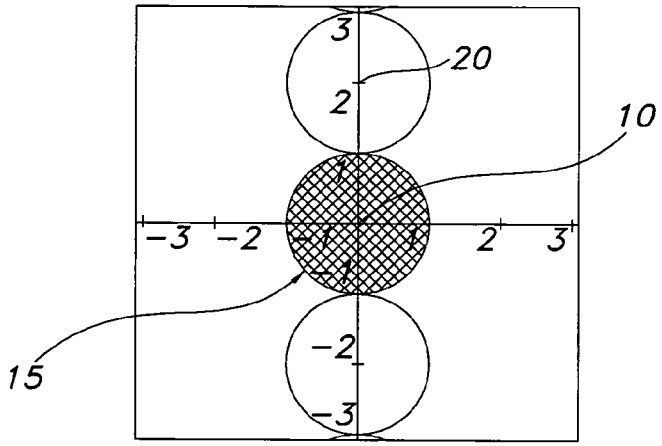
FIG. 6*b* is a grating lobe diagram of the second antenna of FIG. 4.
Figure 6C:
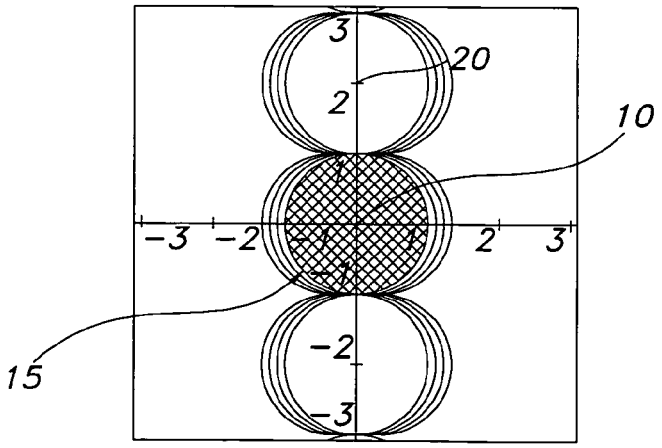
FIG. 6*c* is a gating lobe diagram of the third antenna of FIG. 4.

The antenna configuration shown in FIG. 4 suppresses grating lobes where they become superimposed as shown in FIG. 6*a*, FIG. 6*b*, and FIG. 6*c*. FIG. 6*a* (FIG. 1 repeated for clarity) is the grating lobe diagram for the first or inner antenna 115 of FIG. 4. As shown in FIG. 6*a*, the grating lobes 20 do not intersect the unit circle 15 of the main beam 10 for all scan angles between θ=0 and θ=π/2 for all φ=0° through 360°.

FIG. 6*b* shows the grating lobe diagram for the second antenna 120 operating at 44 GHz. In FIG. 6*b*, the grating lobe 20 circle touches the unit circle 15 for the main beam 10. The grating lobes 20 are superimposed on each other.

FIG. 6*c* shows the grating lobe diagram for the third antenna 125 operating at 30 GHz. In FIG. 6*c*, the grating lobe 20 circle touches the unit circle 15 for the main beam 10. The grating lobes 20 are again superimposed on each other. In FIGS. 6*a*, 6*b*, and 6*c* the radiation element spacing for all three antennas is λ/2 for each frequency.

Radiation elements 110, 111, and 112 that may be integrated together to realize multi-band operation within a radiation element are disclosed in U.S. Pat. No. 6,650,291. In the present invention the center antenna and each frame or ring allows operation on one frequency each. Three frequencies are used as an example. Using the unit cells disclosed in co-pending application in the antennas 100 and 200 of the present invention allows for multiple frequency operation for each frame or ring. Unit cells in the co-pending application operate at two or three frequencies. In this example an antenna operating at six to nine different frequencies is possible. The multiband unit cells with a frame or ring are designed to prevent grating lobes for the bands covered by each frame.

U.S. Pat. No. 6,650,291 also describes phase shifting techniques that may be utilized in the present invention. The co-pending application further describes antenna feed techniques that may be used in the present invention. The following paragraphs summarize techniques applicable to the present invention.

The proposed rectangular waveguides are based on TEM waveguide spatial power combining techniques along with phase shift generated by means of tunable electromagnetic band gap materials. Alternatively, non-amplified, passive waveguide radiation elements utilizing either ferroelectric material loaded phase shifter assemblies, tunable EBG phase shifting waveguide assemblies, or MEMS TTD devices may be employed.

The beam steering control of the array can be realized by traditional printed circuit board, waveguide, or EBG waveguide technologies or alternatively by means of a fiber cable network with fiber optic connections from the beam steering network to either the sub-array or radiating element level.

The antenna concepts shown in FIGS. 4 and 5 can be implemented with different types of radiation elements 110, 111, and 112 than waveguides. Such other types include dipole, microstrip patches (notch, Yagi, spiral, conventional microstrip antennas), circular waveguides, triangular waveguides, etc. Moreover the structure is very flexible and can be practically implemented over a wide frequency range with only a restriction being of physical size limitations and the choice of an appropriate radiating element and feed network. In other words, when a lower operating frequency band is used, the antenna size must be made larger to maintain a maximum separation that validates the superimposing of the grating lobes.

Figure 7:
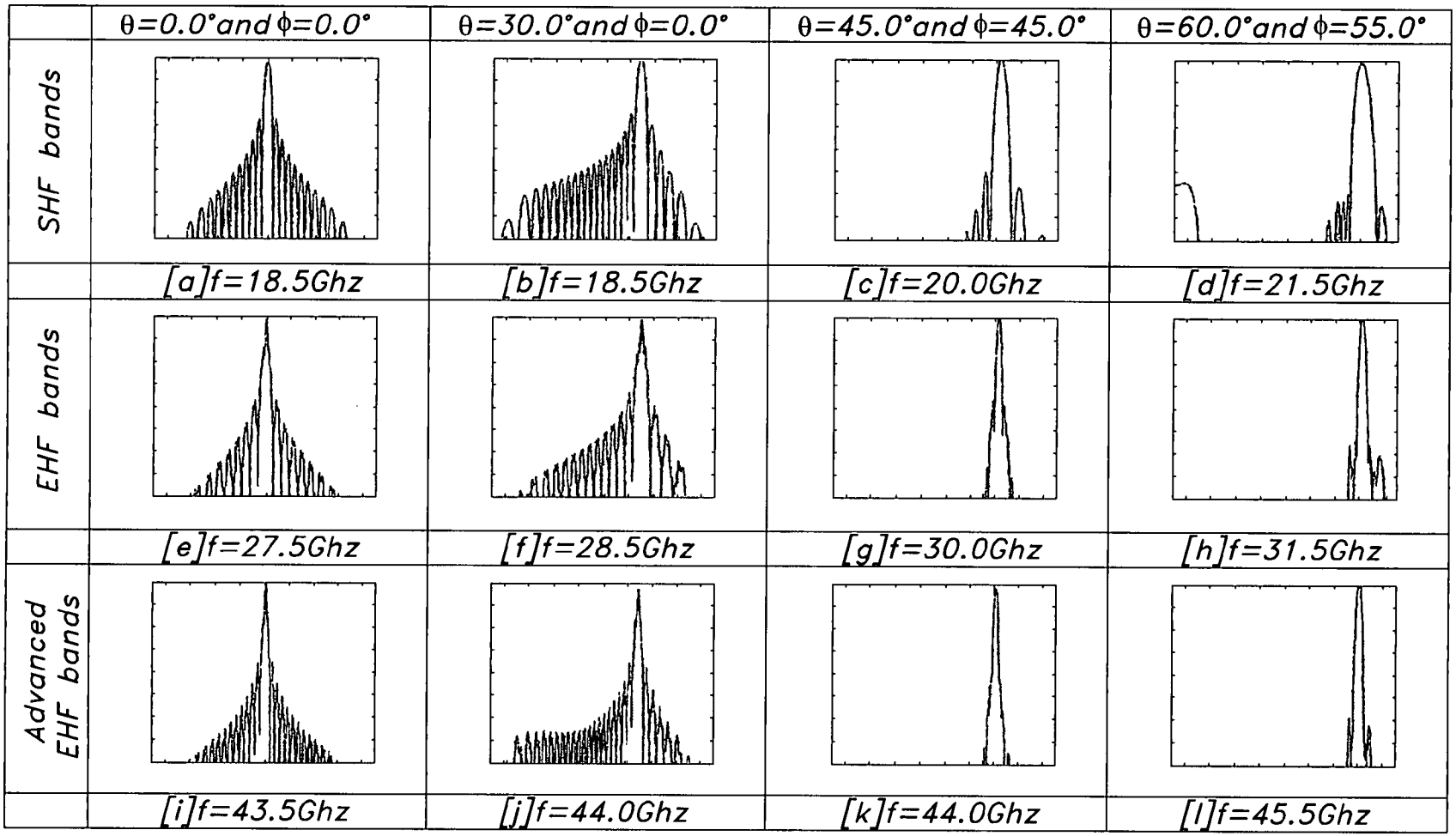
FIG. 7 is a radiation pattern simulation of multi-band wide-angle scan phased array antenna of FIG. 4 at different bands.

FIG. 7 shows computer simulations of the performance of the multi-band wide-angle scan phased array antenna 100 of the present invention. The simulations are shown for each of the three frequency bands. The simulations at the top are in the SHF band (20 GHz) at three different frequencies f=18.5 GHz, 20 GHz, and 21.5 GHz at different elevation angles θ and azimuth angles φ as shown. The simulations in the middle of FIG. 7 are in EHF band (30 GHz) at four frequencies f=27.5 GHZ, 28.5 GHz, 30 GHz, and 31.5 GHz at various elevation and azimuth angles. The simulations at the bottom or FIG. 7 are in the advanced EHF band (44 GHz) at 43.5 GHz, 44.0 GHz, and 45.5 GHz at elevation and azimuth angles as shown. The grating lobe-free performance of the phased array antenna of the present invention is evident from FIG. 7.

It is believed that the multi-band wide-angle scan phased array antenna with novel grating lobe suppression of the present invention and many of its attendant advantages will be understood by the foregoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A multi-band wide-angle scan phased array antenna with novel grating lobe suppression comprising:

a first band antenna for radiating at a first frequency and comprising a first plurality of radiation elements;

a second band antenna for radiating at a second frequency and comprising a second plurality of radiation elements around the first band antenna; and a third band antenna for radiating at a third frequency and comprising a third plurality of radiation elements around the second band antenna.

2. The multi-band wide-angle scan phased array antenna with novel grating lobe suppression of claim 1 wherein:

the first plurality of radiation elements of the first band antenna are in an M×N radiation element configuration;

the second plurality of radiation elements of the second band antenna are in a W×Z radiation element frame-like configuration; and the third plurality of radiation elements of the third band antenna are in a X×Y radiation element frame-like configuration.

3. The multi-band wide-angle scan phased array antenna with novel grating lobe suppression of claim 2 wherein a side dimension of the first band antenna is equal to or less than 13.3 wavelengths at the first frequency.

4. The multi-band wide-angle scan phased array antenna with novel grating lobe suppression of claim 2 wherein a side dimension of the second band antenna is equal to or greater than 30 wavelengths at the second frequency.

5. The multi-band wide-angle scan phased array antenna with novel grating lobe suppression of claim 2 wherein a side dimension of the third band antenna is equal to or greater than 30 wavelengths at the third frequency.

6. The multi-band wide-angle scan phased array antenna with novel grating lobe suppression of claim 2 wherein the first band antenna comprises a square configuration with the first plurality of radiation elements having M=N.

7. The multi-band wide-angle scan phased array antenna with novel grating lobe suppression of claim 6 wherein the second band antenna comprises a square frame-like configuration with the second plurality of radiation elements having W=Z.

8. The multi-band wide-angle scan phased array antenna with novel grating lobe suppression of claim 7 wherein the third band antenna comprises a square frame-like configuration with the third plurality of radiation elements having X=Y.

9. The multi-band wide-angle scan phased array antenna with novel grating lobe suppression of claim 2 wherein the first band antenna comprises a rectangular configuration with the first plurality of radiation elements having M≠N.

10. The multi-band wide-angle scan phased array antenna with novel grating lobe suppression of claim 9 wherein the second band antenna comprises a rectangular frame-like configuration with the second plurality of radiation elements having W≠Z.

11. The multi-band wide-angle scan phased array antenna with novel grating lobe suppression of claim 10 wherein the third band antenna comprises a rectangular frame-like configuration with the third plurality of radiation elements having X≠Y.

12. The multi-band wide-angle scan phased array antenna with novel grating lobe suppression of claim 1 wherein the first, second, and third plurality of radiation elements comprise radiation elements of apertures that are a half wavelength or less of an operating frequency in size.

13. The multi-band wide-angle scan phased array antenna with novel grating lobe suppression of claim 1 wherein:

the first plurality of radiation elements of the first band antenna are in a circular configuration;

the second plurality of radiation elements of the second band antenna are in a circular ring around the first band antenna; and the third plurality of radiation elements of the third band antenna are in a circular ring around the second band antenna.

14. The multi-band phased array antenna having novel grating lobe suppression of claim 13 wherein the first plurality of radiation elements has a radius equal to or less than 6.65 wavelengths at the first frequency, the second plurality of radiation elements has a radius equal to or greater than 15 wavelengths at the second frequency and the third plurality of radiation elements has a radius equal to or greater than 15 wavelengths at the third frequency.

15. The multi-band wide-angle scan phased array antenna with novel grating lobe suppression of claim 1 wherein:

the first plurality of radiation elements of the first band antenna are in an elliptical configuration;

the second plurality of radiation elements of the second band antenna are in an elliptical ring around the first band antenna; and the third plurality of radiation elements of the third band antenna are in an elliptical ring around the second band antenna.

16. The multi-band phased array antenna having novel grating lobe suppression of claim 15 wherein the first plurality of radiation elements has a minor axis equal to or less than 13.3 wavelengths at the first frequency, the second plurality of radiation elements has a minor axis equal to or greater than 15 wavelengths at the second frequency and the third plurality of radiation elements has a minor axis equal to or greater than 15 wavelengths at the third frequency.

17. A multi-band phased array antenna having novel grating lobe suppression comprising:

a first plurality of radiation elements for a radiating at a first frequency and arranged in a square configuration;

a second plurality of radiation elements for radiating a second frequency and arranged in a square frame around the first plurality of radiation elements; and a third plurality of radiation elements for radiating a third frequency and arranged in a square frame around the second plurality of radiation elements.

18. The multi-band phased array antenna having novel grating lobe suppression of claim 17 wherein the first, second, and third plurality of radiation elements comprise radiation elements of apertures that are $\lambda/2$ or less of an operating frequency in size.

19. The multi-band phased array antenna having novel grating lobe suppression of claim 17 wherein the first plurality of radiation elements has a side dimension equal to or less than 13.3 wavelengths at the first frequency, the second plurality of radiation elements has a side dimension equal to or greater than 30 wavelengths at the second frequency and the third plurality of radiation elements has a side dimension equal to or greater than 30 wavelengths at the third frequency.

20. The multi-band phased array antenna with novel grating lobe suppression of claim 17 wherein the first, second and third pluralities of radiation elements may each be one of waveguides, dipoles, microstrip patches, and unit cells.

* * * * *